US005746327A

United States Patent [19]

Leermakers et al.

[11] Patent Number: 5,746,327

[45] Date of Patent: May 5, 1998

[54] RECEIVING MATERIAL HOLDER

[75] Inventors: Johannes M.H.P.L. Leermakers, Venlo; Albertus M.B.M. Van Os, Grathem; Cornelis H.J. Slaats, Neer, all of Netherlands

[73] Assignee: OCE-Nederland, B.V., Venlo, Netherlands

[21] Appl. No.: 614,800

[22] Filed: Mar. 7, 1996

[30] Foreign Application Priority Data

Mar. 7, 1995 [NL] Netherlands ..... 9500445

[51] Int. Cl.[6] ..... A47F 7/00

[52] U.S. Cl. ..... 211/50; 211/181.1; 211/45

[58] Field of Search ..... 211/50, 181, 45; 400/613.2, 625, 624; 271/42, 9.11, 207, 209; 248/918

[56] References Cited

U.S. PATENT DOCUMENTS 4,119,207 10/1978 Fuller et al. ..... 211/45
4,140,221 2/1979 Garland ..... 211/181 X
4,828,118 5/1989 Deavier ..... 211/50
4,923,188 5/1990 Neir ..... 400/613.2 X
5,052,674 10/1991 Bell .
5,197,608 3/1993 Stangenberg et al. ..... 211/50

FOREIGN PATENT DOCUMENTS 366167 5/1990 European Pat. Off. .
9111484 11/1991 Germany .

*Primary Examiner*—Robert W. Gibson, Jr.
*Attorney, Agent, or Firm*—Birch, Stewart, Kolasch & Birch, LLP

[57] ABSTRACT

A free-standing holder for a stack of receiving material in sheet form has two supports disposed at an angle of 65°. The holder is formed by two members and a wire rack. The rack is fixed between the two members and has a concave supporting surface. An abutment ledge is at the bottom of the holder and is perpendicular to the support surface. The supports are connected at the top by a brace forming a handle for moving the holder. Channel-shaped yokes can be fixed to the wire rack to accommodate rolls of receiving material.

18 Claims, 4 Drawing Sheets

RECEIVING MATERIAL HOLDER

FIELD OF THE INVENTION

The invention relates to a receiving material holder comprising at least one sloping support for a stack of receiving material in sheet form.

DESCRIPTION OF THE INVENTION

A holder of this kind for large-format receiving sheets is known from U.S. Pat. No. 5,052,674, which describes a holder received in a bottom frame of a copying machine. The holder is formed by a flat box forming an angle of 20° with the horizontal. If the copying machine is disposed at a normal working height for a standing operator, the receiving material holder will necessarily be lower than this working height so that the operator repeatedly has to bend down to remove a sheet from the holder. Because of the small angle of inclination, the known holder occupies a large floor area. If this angle of inclination is 20°, this area is substantially the same as the largest format of the sheets to be accommodated.

SUMMARY OF THE INVENTION

The object of the invention is to provide a receiving material holder without these above-described disadvantages.

In a holder with a sloping support according to the invention, the holder is free-standing and the sloping support received in the holder has an angle of inclination of between 55° and 75° and preferably between 60° and 70°.

Consequently, the holder is flexible and can be disposed at a good working height for a standing operator without occupying a large floor area.

In one embodiment, the sloping support has a horizontally concave shape. Consequently, sheets lie on the support with a slight curvature in the horizontal direction so that they cannot readily bend vertically, even if the support slopes considerably.

If an abutment ledge is provided along the bottom edge of the support and includes an angle of 90° with the sloping support, sheets lying against the support cannot readily slide down.

By providing the bottom of the holder with smooth cups and providing the top with a handle between parallel supports, the holder can readily be placed in any required position with respect to a sheet-processing device, such as a copying machine or folder.

The free-standing holder can also be used to fix yokes thereon, in which rolls of receiving material can be placed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 2:
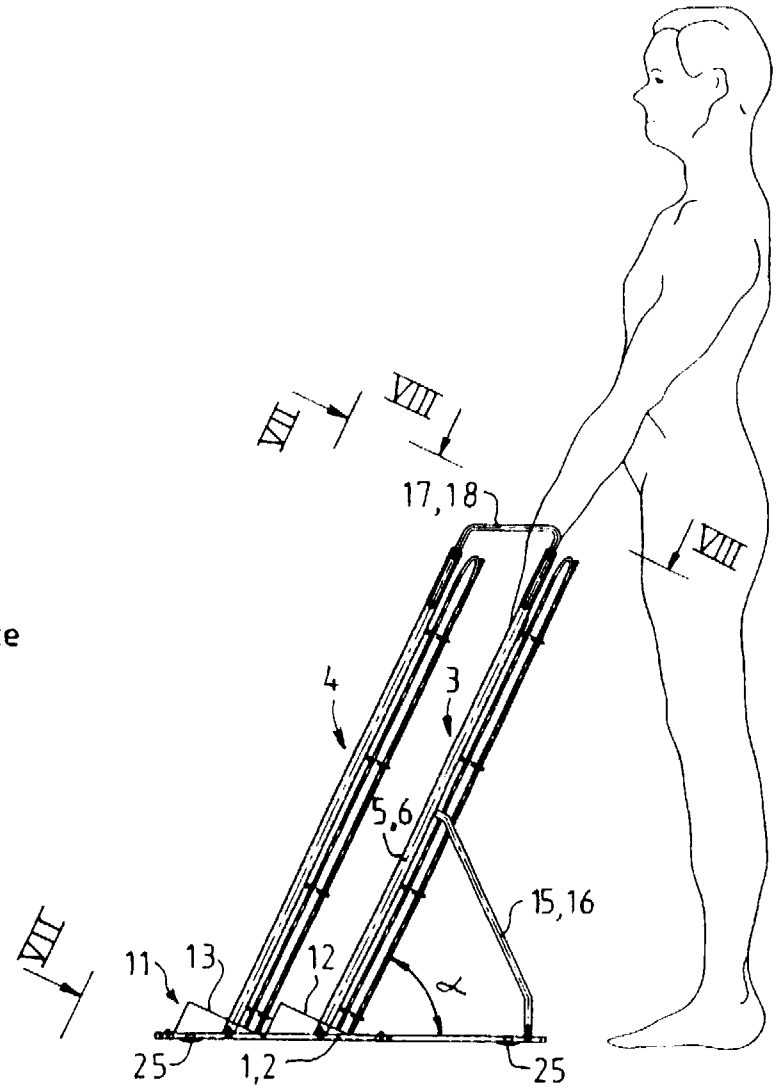
FIG. 2 is a side elevation of the holder shown in FIG. 1.

The receiving material holder shown in the drawings comprises two interconnected members 1 and 2 spaced 1000 mm apart and each approximately 700 mm long. Two sloping supports 3 and 4 are secured to the two horizontal members 1 and 2 to receive a stack of receiving material in sheet form. The supports 3 and 4 are of identical construction so that only support 3 will be described in detail.

Figure 8:
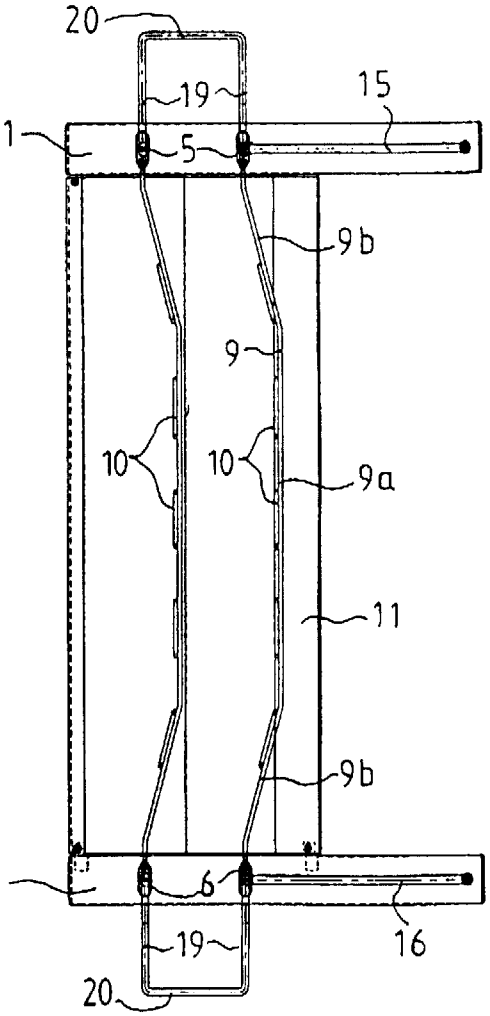
FIG. 8 is an elevation on the line VIII—VIII in FIG. 2.
Figure 7:
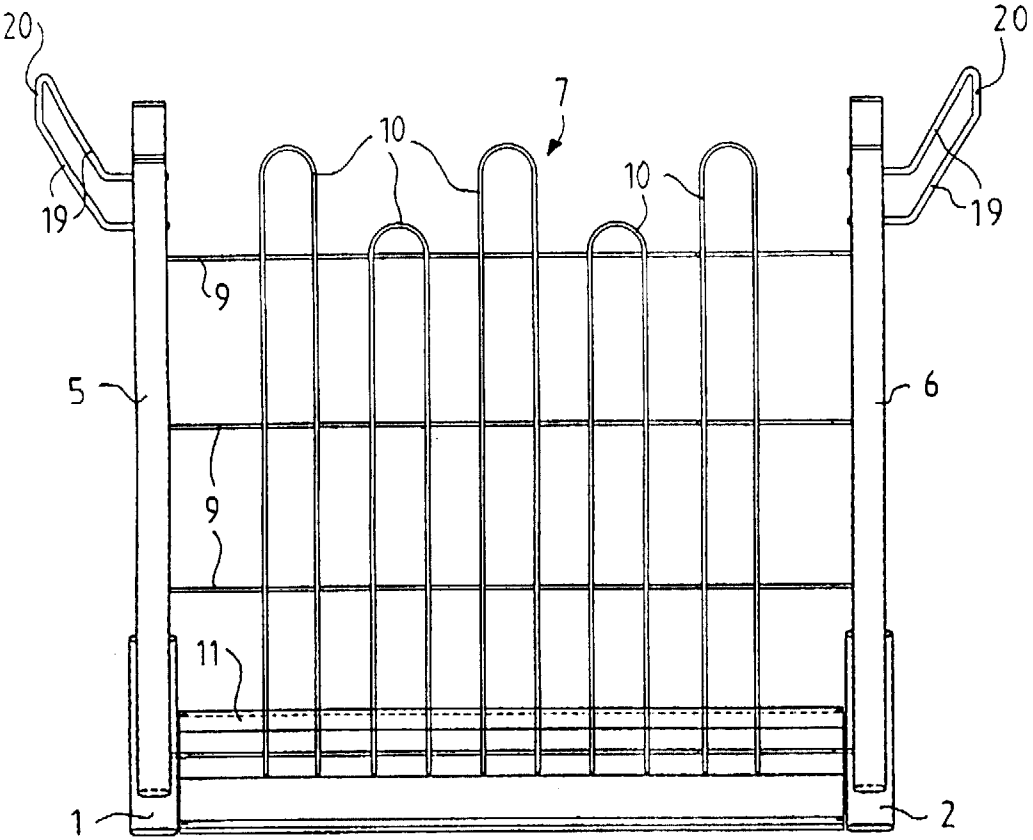
FIG. 7 is an elevation on the line VII—VII in FIG. 2.

Support 3, and hence also support 4, is formed by two flat tubular members 5 and 6 secured to the sides of a rack 7 made of iron wire. Tubular members 5 and 6 and rack 7 form a unit. Each of the members 5 and 6 is fixed to a horizontal member 1, 2 respectively and at an angle $\alpha$ of 65°. The rack 7 has four wires 9 interconnecting the members 5 and 6 at regular intervals. At a short distance from these members each wire has a 15° bend and at a distance of about 200 mm a 15° bend in the opposite direction. These bends are clearly visible particularly in FIG. 8. Five bent wires 10 are fixed to the upwardly extending side of the wires 9 at regular intervals and more particularly, together with the sloping members 5 and 6, form the supporting surface of the sheet support 3. The horizontal members 1 and 2 are also interconnected by a plate 11 forming an abutment surface 12, 13 respectively at the bottom of each support 3, 4, for a stack of sheets. This plate 11 has a saw-tooth shape as seen in FIG. 2.

The abutment surfaces 12, 13 include an angle of 90° with the supporting surface formed by members 5 and 6 and rack 7. To provide sufficient stability for the support 3, two rods 15 and 16 are fixed between the sloping members 5 and 6 of support 3 and the horizontal members 1 and 2. Each of these rods 15 and 16 forms an equilateral triangle with the associated members 1 and 5; 2 and 6, respectively. To provide sufficient stability for the support 4, the sloping members 5 and 6 of supports 3 and 4 are interconnected at the top by braces 17, 18 respectively.

Figure 1:
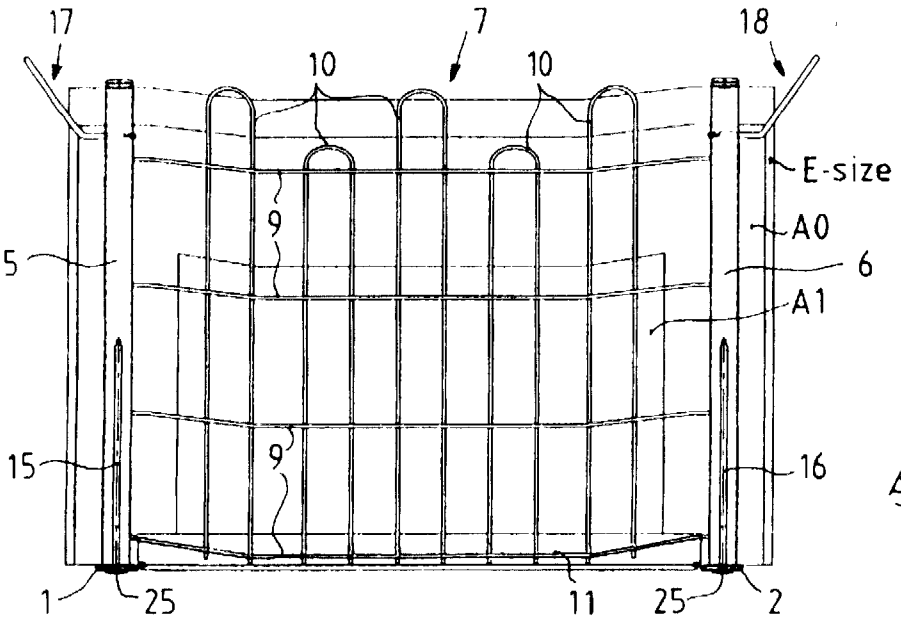
FIG. 1 is a front elevation of a holder according to the invention.

The braces 17 and 18 are substantially U-shaped, the limbs 19 being situated in a plane parallel to the supports and the connecting member 20 extends parallel to the horizontal members 1 and 2. The connecting members 20 are spaced apart an amount greater than the maximum horizontal dimension of sheets to be accommodated in the holder and at a distance from the abutment surface 12 greater than the maximum vertical direction of sheets to be accommodated in the holder. The maximum sheet format fitting in the holder described here is the DIN format AO and the American E-size format (35"×48") shown in FIG. 1. FIG. 1 shows not only the contours of an AO format placed in the holder but also the AI format.

An operator can drop a stack of sheets, whether in their transportation package or not, into the holder from above or push the stack from the side over the abutment surface 12 or 13 into the holder until the sheets occupy the position indicated in FIG. 1 in the case of AO and Al formats. Particularly if receiving sheets without a package are to be placed in the holder, they will follow the concave shape of the rack 7. This curvature greatly increases resistance to vertical bending.

If the slope angle α is much greater than 70°, then there is an increasing risk of bends, particularly with a flat supporting surface. In the case of a slope angle α being much less than 60°, the length required for the horizontal members 1 and 2 increases greatly, while the top edge of AO sheets placed in the holder will also come to lie at such a low level that an operator cannot take a sheet from the holder without bending down.

The abutment ledges 12 and 13 disposed perpendicularly to the supporting surface of the associated support 3 or 4 prevents sheets placed in the holder from easily sliding away at their bottom edges (something which can occur easily in the case of an included angle of more than 90°) or from easily bending (something which can easily happen in the case of an included angle of less than 90° since the bottom edge comes into the sharp corner formed and thus bulges out).

Figure 4:
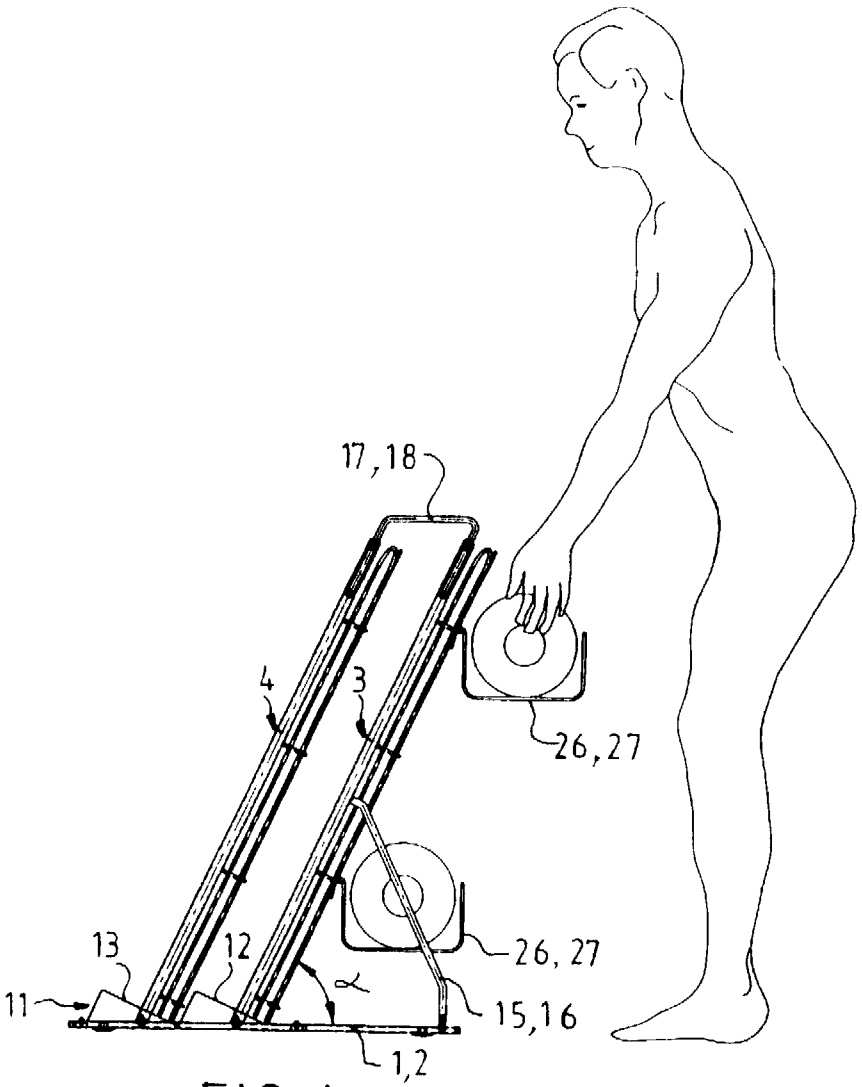
FIG. 4 is a side elevation of the holder shown in FIG. 3.

Removal of a sheet from the holder is a simple matter for an operator standing in front of the holder as shown in FIGS. 2 and 4. Without bending down the operator can take hold of the top edge of each sheet with two hands and lift it out of the holder.

The supports 3 and 4 of the holder can be used for the storage of stacks of sheets of different formats, and also to accommodate originals still requiring to be copied and/or already copied. The slightly bent shape of the support surfaces means that there is also little risk of these loose sheets sliding down through bending and thus being damaged.

The holder is also suitable for accommodating copies coming from a copying machine placed near the holder. For separate storage of a diversity of sheets, a holder according to the invention can be provided with more than the supports 3 and 4 shown in the drawings.

To enable the holder to be readily moved, the bottoms of horizontal members 1 and 2 have smooth plastic cups 25 which readily slide over a floor when the operator pushes or pulls one or both handles 17, 18. The cups 25 avoid any appreciable risk of the holder moving in the event of an inclined floor which might happen if unlocked castors are used beneath the holder.

The above-described holder is constructed with a lightweight rack 7. This is possible because large-format sheets, which are the heaviest, largely rest against the sloping members 5 and 6 and thus relieve the rack of load.

Figure 3:
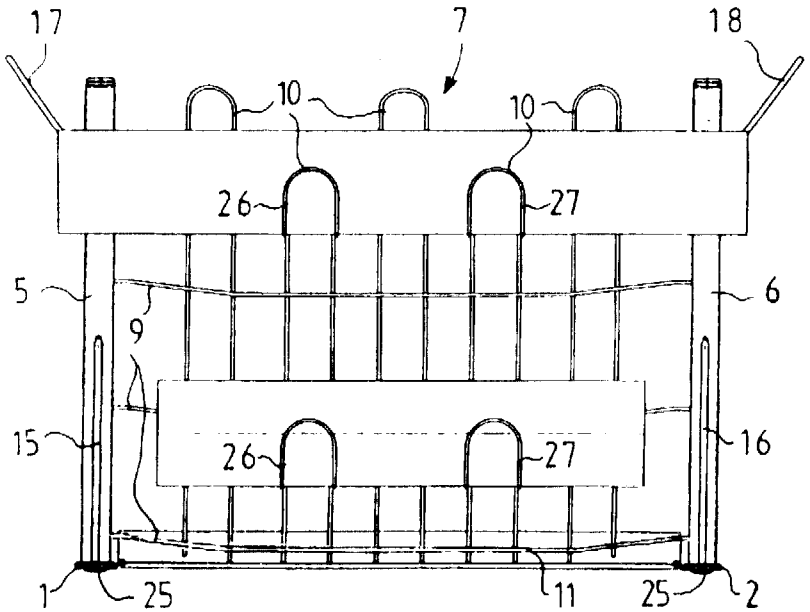
FIG. 3 is a front elevation of another holder according to the invention.
Figure 6:
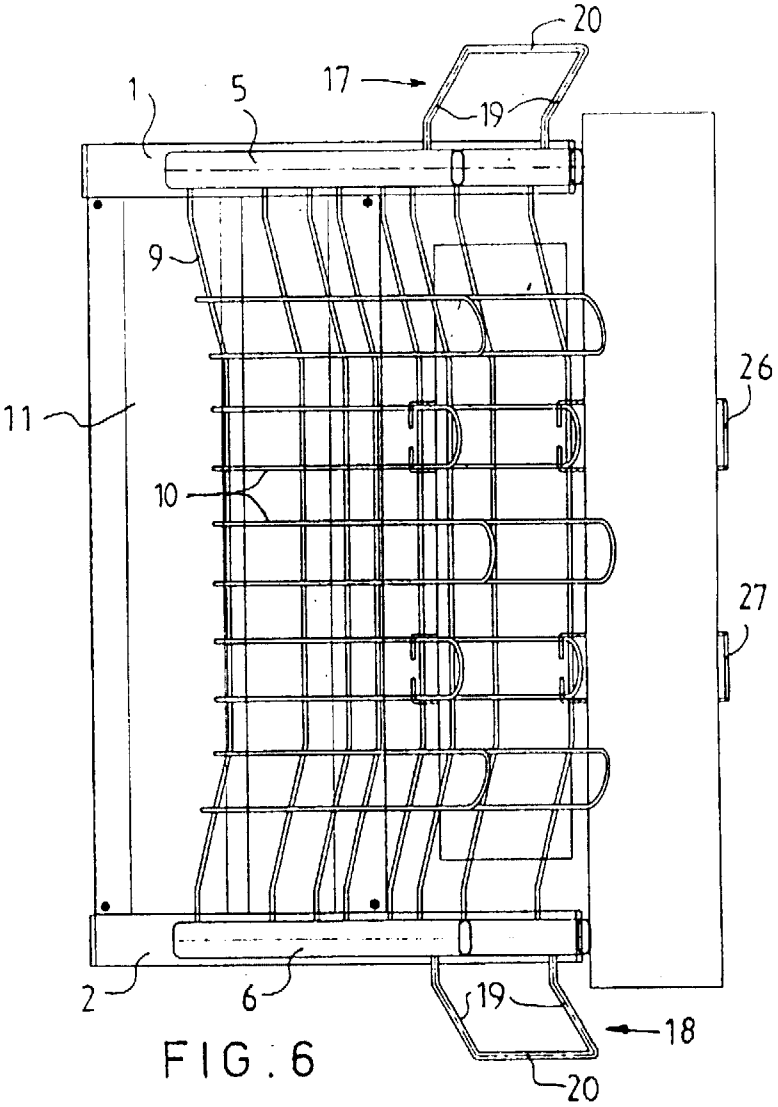
FIG. 6 is a top plan view of the holder shown in FIGS. 3 and 4.
Figure 5:
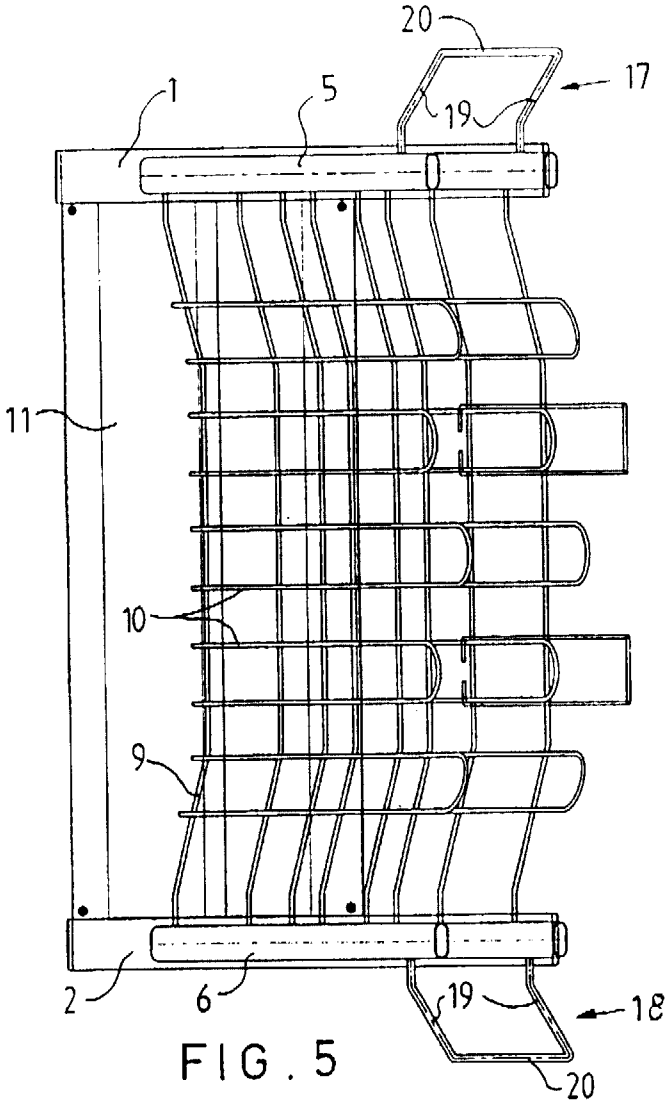
FIG. 5 is a top plan view of the holder shown in FIGS. 1 and 2.

As shown in FIGS. 3, 4 and 6, at the front of the holder, two channel-shaping yokes 26 and 27 can be hooked at the same height to wires 9 of the rack 7. These yokes 26 and 27 can be considered as means for receiving a roll of receiving material. A reserve roll of receiving material can be placed in these yokes 26 and 27, such feed roll being adapted, for example, to be placed in a copying machine disposed near the holder according to the invention. The holder provides space for two superposed roll holders as shown in FIGS. 3 and 4. Of course, the superposed rolls in the holders can be the same size or different sizes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A holder for sheet material, the holder comprising at least one sloping support for receiving a stack of sheet material, the holder being free-standing and the support sloping at an angle between 60° and 70° relative to horizontal, the at least one sloping support having a horizontally concave shape.

2. The holder according to claim 1, wherein the at least one sloping support has a generally flat middle part with adjoining side parts on each side thereof, the side parts being connected to the middle part of the at least one sloping support at an obtuse angle.

3. The holder according to claim 2, wherein the at least one sloping support comprises a plurality of sloping supports, each of the sloping supports having a concave shape with the generally flat middle part and adjoining side parts.

4. The holder according to claim 3, wherein the sloping supports are generally parallel to one another.

5. The holder according to claim 2, further comprising an abutment ledge provided at a bottom edge of the at least one support, the abutment ledge being generally perpendicular to the sloping support.

6. The holder according to claim 5, further comprising a horizontal member provided at the bottom of the holder and wherein each of the at least one sloping support is formed by two generally parallel side members and a rack extending between said side members, each of the at least one sloping member being secured to the horizontal member which extends beneath the sloping member.

7. The holder according to claim 6, further comprising smooth cups provided on an underside of the horizontal member.

8. The holder according to claim 6, wherein two horizontal members are provided beneath the at least one sloping support, each of the horizontal members having smooth cups provided on an underside thereof.

9. The holder according to claim 6, wherein the at least one sloping support comprises two sloping supports, each of the sloping supports being connected at a top thereof by at least one brace, the at least one brace forming a handle.

10. The holder according to claim 9, wherein the at least one brace is connected to corners of the two sloping supports and wherein the handle of the at least one brace is positioned above the supports.

11. A holder for sheet material, the holder comprising:

at least one sloping support for receiving a stack of sheet material, the holder being free-standing and the support sloping at an angle between 60° and 70° relative to horizontal; and means for receiving a roll of receiving material, the means for receiving being releasably connected to the holder.

12. The holder according to claim 11, wherein the means for receiving comprises at least one channel-shaped yoke detachably mounted to one side of the at least one support, an opposite side of the at least one support engaging the stack of sheet material.

13. The holder according to claim 12, wherein the at least one sloping support comprises two sloping supports and wherein the means for receiving is attached to only one of the sloping supports.

14. The holder according to claim 12, wherein the at least one channel-shaped yoke comprises a plurality of side-by-side yokes such that different rows of yokes are provided on the sides of the at least one support, each of the rows of yokes having a plurality of yokes therein.

15. A holder for sheet material, the holder comprising at least one sloping support for receiving a stack of sheet material, the holder being free-standing and the support sloping at an angle between 60° and 70° relative to horizontal, the at least one sloping support comprises a plurality of sloping supports, the holder further comprising an abutment ledge provided at a bottom edge of each of the sloping supports, the abutment ledges being generally perpendicular to the sloping supports, edges of the sheet material in the sloping supports engage the abutment ledge, each of the sloping supports having a generally flat middle part and two adjoining side parts, the adjoining side parts being on each side of the middle part and being angled relative to the middle part whereby each of the sloping supports has a concave shape, the sloping supports bowing the sheet material received thereon due to the concave shape to thereby increase rigidity of the sheet material.

16. The holder according to claim 15, wherein height and length of each of the sloping supports is less than height and length of a largest size of sheet material to be received thereon.

17. The holder according to 15, wherein an angle of 15° is formed between each of the adjoining side parts and the middle part of each of the sloping supports.

18. The holder according to claim 1, wherein the at least one sloping support comprises a plurality of sloping supports, each of the sloping supports having a uniform spacing therebetween.

* * * * *